US005660505A

United States Patent [19]

Emory, III

[11] Patent Number: 5,660,505

[45] Date of Patent: Aug. 26, 1997

[54] SILT FENCE ANCHOR

[75] Inventor: J. Brooks Emory, III, Birmingham, Ala.

[73] Assignee: Enviro-Guard, L.L.C., Birmingham, Ala.

[21] Appl. No.: 541,520

[22] Filed: Oct. 10, 1995

[51] Int. Cl.[6] ..... E02D 29/00

[52] U.S. Cl. ..... 405/258; 24/543; 256/12.5; 256/52; 405/15; 405/21

[58] Field of Search ..... 405/258, 21, 15; 256/12.5, 48, 49, 52; 24/543, 324, 30.5

[56] References Cited

U.S. PATENT DOCUMENTS

| | | | |
|---|---|---|---|
| 1,175,458 | 3/1916 | Langehennig | 256/52 |
| 1,226,465 | 5/1917 | Campbell | 256/52 |
| 1,323,144 | 11/1919 | Alig | 256/52 |
| 1,450,644 | 4/1923 | Pracht | 256/52 |
| 1,655,673 | 1/1928 | Cass | 256/52 |
| 4,804,299 | 2/1989 | Forte et al. | 405/258 X |
| 4,807,334 | 2/1989 | Blanchard | 24/543 X |
| 5,039,250 | 8/1991 | Janz | 405/16 X |
| 5,108,224 | 4/1992 | Cabaniss et al. | 405/21 X |
| 5,123,146 | 6/1992 | Olson | 24/30.5 P X |

FOREIGN PATENT DOCUMENTS

| | | | |
|---|---|---|---|
| 4241202 | 6/1994 | Germany | 256/12.5 |

*Primary Examiner*—Dennis L. Taylor
*Attorney, Agent, or Firm*—Veal & Associates

[57] ABSTRACT

A device and method for anchoring a silt barrier curtain intermediate primary barrier supports to enhance erosion control. The device has interlocking members protruding from a base designed to clamp onto the lower edge of a silt curtain. The device and the silt curtain locked therein are then buried during barrier construction to a predetermined depth. Indicia on the exterior of the device allow easy verification of proper burial depth. The device may be used on cyclone style fences, or used in aquatic environments to prevent silt or floating debris from intruding into a protected area.

43 Claims, 5 Drawing Sheets

SILT FENCE ANCHOR

FIELD OF THE INVENTION

This invention relates to silt or barrier fencing designed to hold back silt or sand in an area susceptible to erosion. More particularly, the invention relates to anchoring devices for securing silt fencing that prevents silt and earth erosion at construction sites. In even more particularity, the current invention relates to anchoring devices for silt fencing spaced between the primary fencing supports, and such devices include indicia for verifying proper burial depth.

BACKGROUND OF THE INVENTION

Construction sites are prone to erosion of topsoil and loose silt from both wind and rain. Unchecked erosion can cause serious damage to the environment, injure surrounding farm lands, block highways, and choke navigation routes. Certain aquatic environments are especially sensitive to silt intrusion. It is swell known that silt from construction run-off or navigation dredging can kill coral reefs and choke-off other bay invertebrates. Marshlands are similarly sensitive. Protecting natural environments that are near construction areas necessitates erecting barriers to arrest erosion.

Many systems and apparatuses exist to arrest erosion and drifting of loose sand, snow, or silt. U.S. Pat. No. 4,756,511 issued to Wright, III discloses a silt fence comprising a plurality of pointed end stakes having fabric secured to the stakes with mounting strips. U.S. Pat. No. 3,426,536 issued to Danz discloses a device for impeding the flow of sand or silt utilizing an interweaving of horizontal strips of material between spaced apart upright posts. The strips have a feature of vertical relocation. U.S. Pat. No. 4,932,634 issued to Sura shows a snow fence utilizing horizontal plastic slats supported by attachment ears on fence posts. U.S. Pat. No. 5,131,630 issued to Nash discloses a drift fence for retaining snow or sand using tubular slats held together by parallel cords and H-shaped retainers. However, with the exception of Wright, III, these systems provide relatively complicated or expensive solutions to address drifting or eroding sand or silt. Wright, lit, incorporates inexpensive woven fabric mounted to simple wooden stakes with mounting strips to create a barrier, but Wright does not provide a means for anchoring the bottom of the fabric to the ground at an intermediate point between each wooden stake. Without adequate anchoring, silt and other loose topsoil will invariably pass beneath a barrier fence as the silt builds up against the barrier. Shortening the distance between the support stakes to adequately anchor the fence fabric is prohibitively expensive due to material and installation costs. A need exists for an inexpensive device for securing the bottom of fabric fencing to the ground between fence supports at a fraction of the labor costs of erecting a full support.

Wright and the other references also do not provide any means for gauging the burial depth of the lower edge of a fabric barrier. To effectively prevent the erosion of silt or other small particle erosion, a fabric style barrier should have its lower edge buried beneath the ground to a predetermined depth, typically six inches. Some states, in fact, mandate use of silt fences or barriers at construction sites to prevent erosion. Erosion control construction codes that require silt fencing usually specify a minimum burial depth of the lower edge of the fencing fabric. These codes place a heavy burden on construction foreman who must verify code compliance. Most construction managers currently measure fencing depth during installation or after installation through manual inspection probes. However, this method requires additional training for construction managers and work crews, and does not yield consistent depth results. Therefore, there is a need in the industry for a quick and inexpensive system to determine fence burial depth that can be used by construction foreman work crews.

In addition to construction codes, some localities require county inspectors to verify the depth of the silt fencing. The inspectors either must be present during the installation or probe the fence depth manually to verify depth. This places a heavy burden on inspectors who may not have the time to adequately inspect the fencing. A built-in gauge on the lower edge of the fabric fence would greatly simplify an inspectors task and increase quality inspections. Therefore, the construction industry has a need for code certified gauges can provide readily discernible and highly visible indicia so that inspectors and foremen can verify correct depth from a distance.

In addition to burying silt or barrier fencing to prevent erosion cyclone fences are frequently buried to prevent entry of animals either into or out of a protected area. Proper burial depth and the anchoring of the bottom the fences is also important as in the case of the silt fencing. The disclosed invention also addresses this need.

SUMMARY OF THE INVENTION

Accordingly, it is the object of the present invention to provide an inexpensive apparatus to anchor fencing intermediate the primary supports of the fencing.

Another object of the invention is to provide a means to readily discern the burial depth of the lower edge of silt or barrier fencing for inspectors and construction foremen.

Still another object of the invention is to provide an inexpensive device for anchoring silt fencing intermediate the primary support of the fencing by clamping onto the lower edge of the fencing fabric and being buried to a predetermined depth.

Another object of the invention is to provide an apparatus and method for arresting erosion of silt and loose earth in construction areas or other erosion susceptible areas.

Yet another object of the invention is to provide an apparatus and method for anchoring silt fencing so that the depth of the lower edge of the silt fencing fabric or silt curtain can be readily discernible by inspectors, foremen, and work crews.

Still another object of the invention is to provide an anchoring device for cyclone fencing intermediate the primary supports of the cyclone fence.

Other features and objects and advantages of the present invention will become apparent from reading of the following description as well as a study of the appended drawings.

The apparatus may be briefly described as a small and inexpensive plastic unit that has a disk shaped base and two elongated members perpendicular to the base. One of the members is hinged at or near the base so that the pivotal member can be opened to receive the bottom of a fence. The members contain interlocking plugs so that when the two members are closed together around the bottom of the fence they and the fence are locked together. The unit and bottom of the fence are then buried below the ground with the top of the apparatus showing slightly. Indicia on the apparatus indicate proper burial of the device to a predetermined depth.

BRIEF DESCRIPTION OF THE DRAWINGS

Device embodying features of the invention are illustrated in the enclosed drawings which form a portion of this disclosure and wherein.

DETAILED DESCRIPTION OF THE PREFERRED EMBODIMENT

Figure 1A:
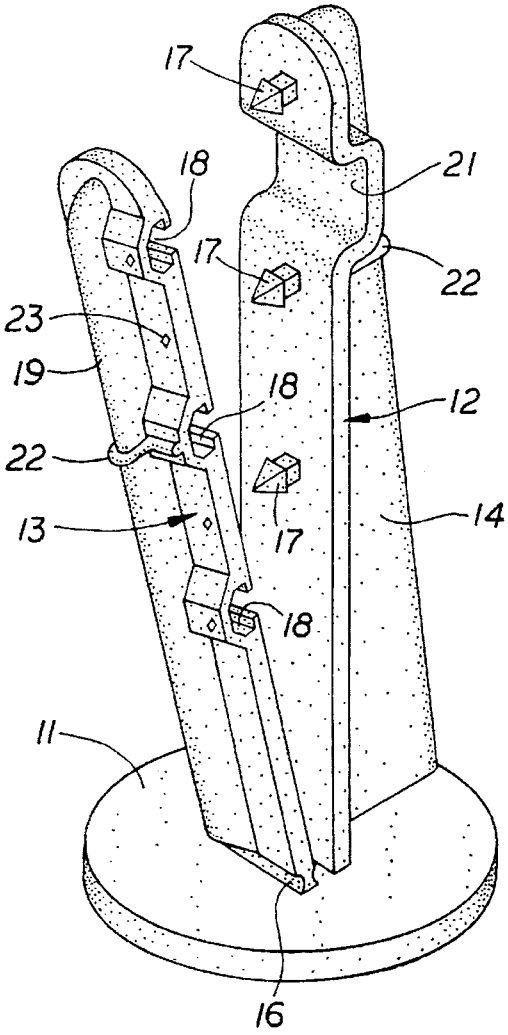
FIG. 1A is a perspective view showing the entire device with the pivotal member open relative to the adjacent member.
Figure 1B:
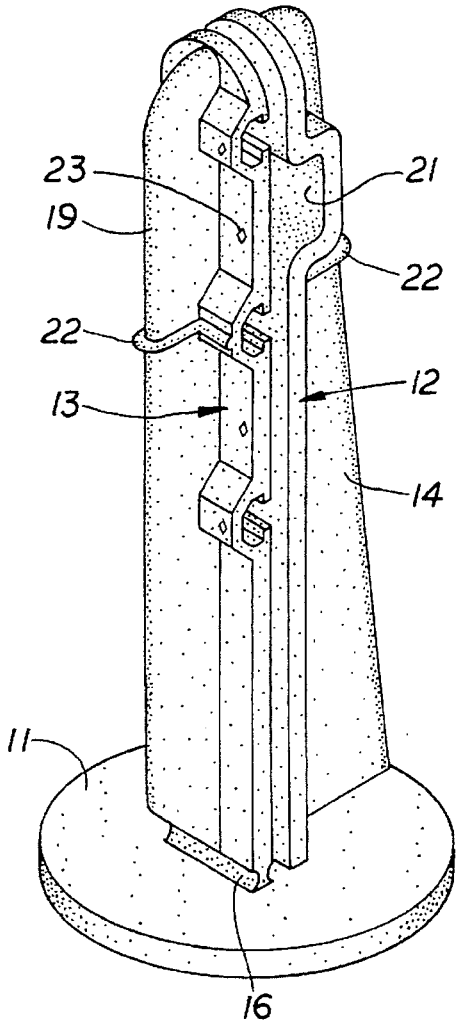
FIG. 1B is a perspective view showing the entire device with the pivotal member closed relative to the adjacent member.
Figure 2:
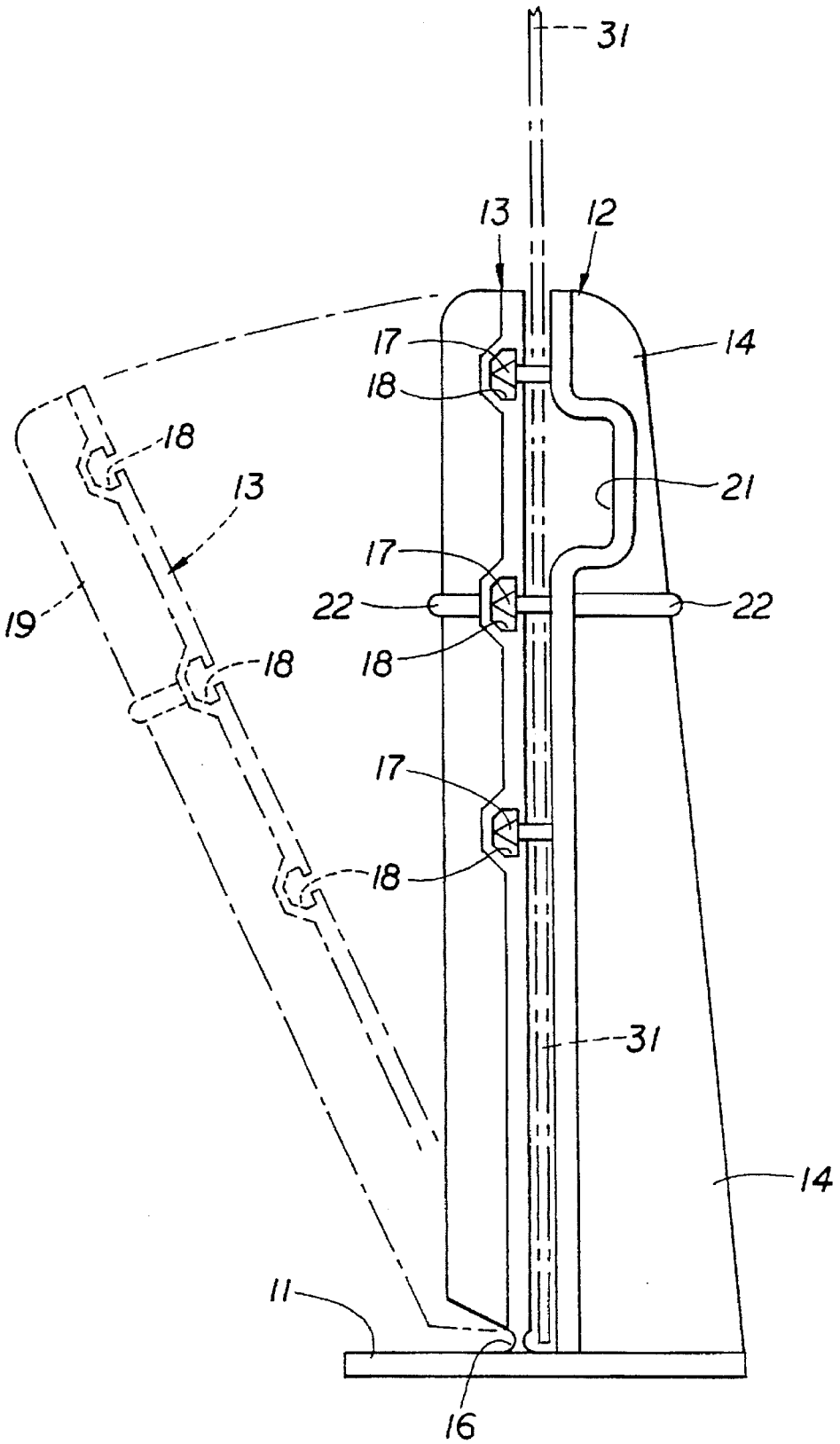
FIG. 2 is a side elevational view of the device.
Figure 3:
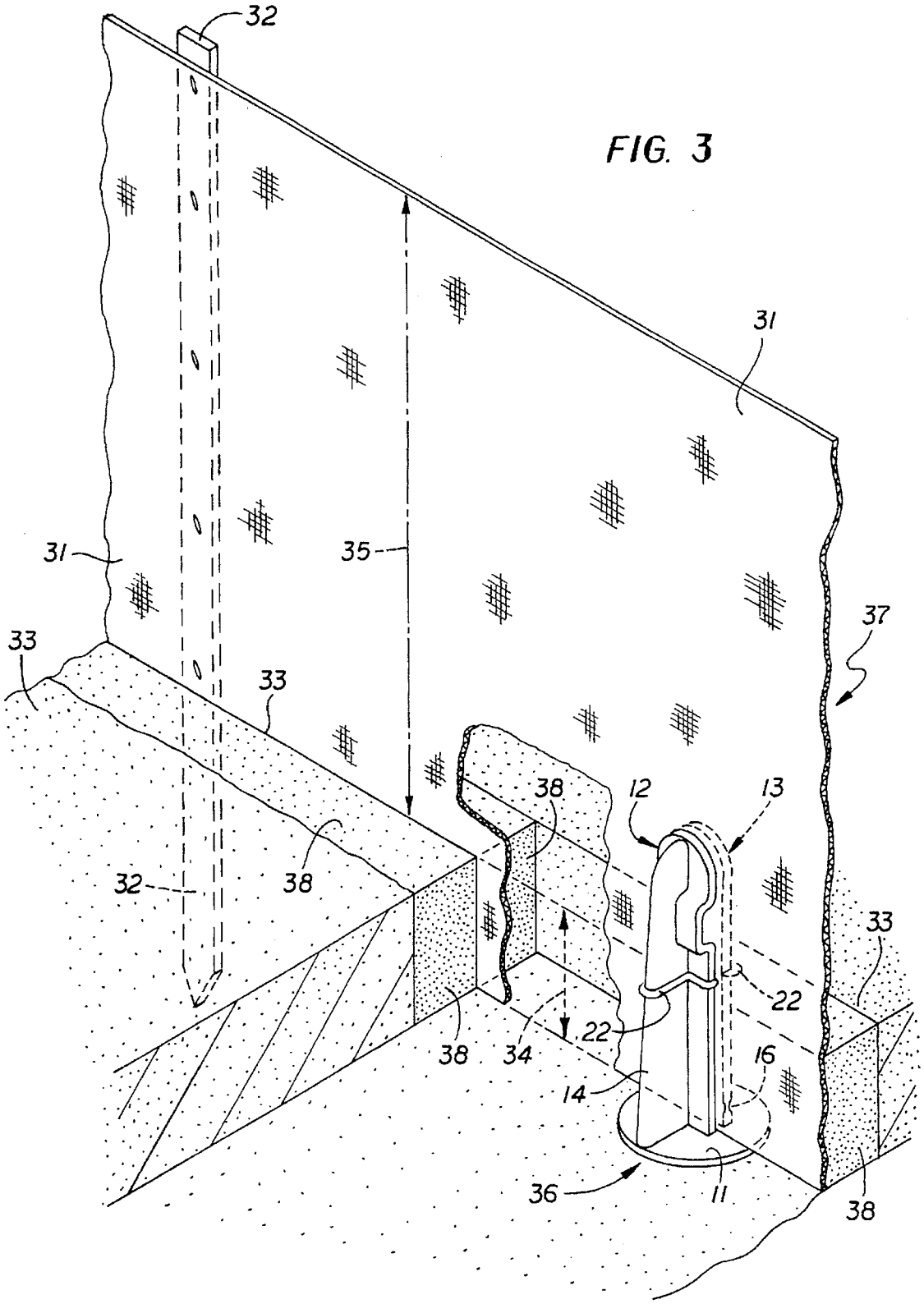
FIG. 3 is a reduced scale perspective view partially broken away and in section showing the device buried to a proper depth and clamped around the bottom portion of a silt fence.
Figure 6:
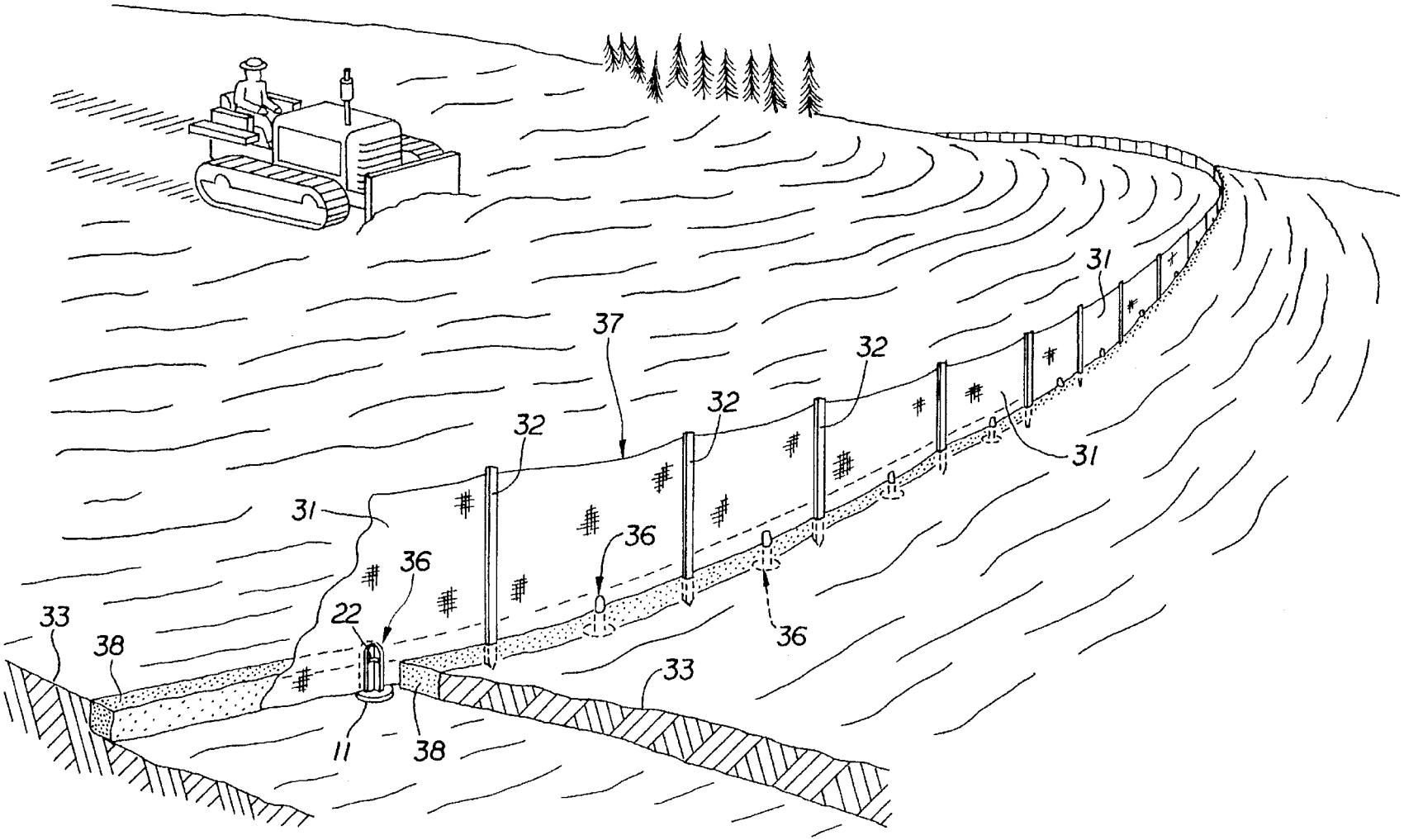
FIG. 6 is a reduced scale environmental view showing the devices anchoring a silt curtain at a construction site.

Referring to the drawings for a better understanding of the device, it will be seen that FIG. 1A shows an overall view of the invention comprising a disk shaped base 11 supporting two opposing elongated members 12 and 13. Base 11 must be of sufficient size to secure the device and secure the silt fence bottom after burial. Although the shown embodiment depicts a disk shaped base, any shape that adequately secures the device may be used. Member 12 is rigidly affixed to base 11 and has a rear support rib or buttress 14 to supplement the rigidity of fixed member 12. Member 13 is attached to base 11 with a living hinge 16 adjacent fixed member 12 allowing member 13 to be pivoted away from and toward fixed member 12. A living hinge of resilient plastic 16 may be created during an injection molding process and would be integral to hinged member 13 and base 11 as is well known in the injection molding art. However, an additional hinge element can easily replace the living hinge 16 to interconnect member 13 to base 11. In addition, fixed member 12 could also be connected to base 11 through a hinge, thereby allowing a greater gap between each member when pivoted away from each other. Hinges on both members would facilitate installation on a silt curtain or barrier. Member 13 also has a support column 19 running the length of member 13 to increase rigidity. Both members contain elements of a locking means so that the bottom of a silt curtain or other fence can be clamped between the members when closed. FIG. 1A shows member 13 pivoted away from fixed member 12. Snap-fit plugs 17 extend out from the face of fixed member 12 and hinged member 13 has corresponding plug recesses 18 so that member 13 can closed upon member 12, locking both members together as shown in FIG. 1B. Snap-fit plugs 17 include a flange slightly bigger than recess 18 to retain the plug within the recess after full insertion as is well known in the art. Plugs 17 and plug recesses 18 may be located in different members or in both to facilitate locking. As shown in FIG. 1A, the plugs 17 may be sufficiently pointed to pierce nylon fabric or other silt curtain fabrics. The inside face of member 12 also includes a transverse recess 21 to allow attachment of the device to the bottom of a cyclone style fence. The topmost snap-fit plug 17 is positioned to pass through the spaces between wires of a cyclone fence and the recess 21 holds the bottom wires to secure the device to the bottom of the fence. The cyclone fence and attached device can then be buried as with a silt fence to achieve the same depth conformity results. FIG. 3 and FIG. 6 indicate that the device is positioned intermediate the main supports of the silt curtain. Installation of a silt barrier requires excavating a trench 38, driving main supports 32 into the trench, and attaching a silt curtain 31 or similar material to the supports as is well known in the art. The curtain 31 is attached to the main supports so that the bottom edge of the curtain lies within the trench 38, typically to a depth of six inches 34, and extends to a predetermined height 35 above the ground surface 33. The silt anchor device 36 is then clamped around the bottom of the curtain intermediate the main supports 32. The base 11 of the device 36 rests upon the trench floor and dirt is back filled over the base and up to a predetermined height marked by an indicia bead 22.

Figure 4:
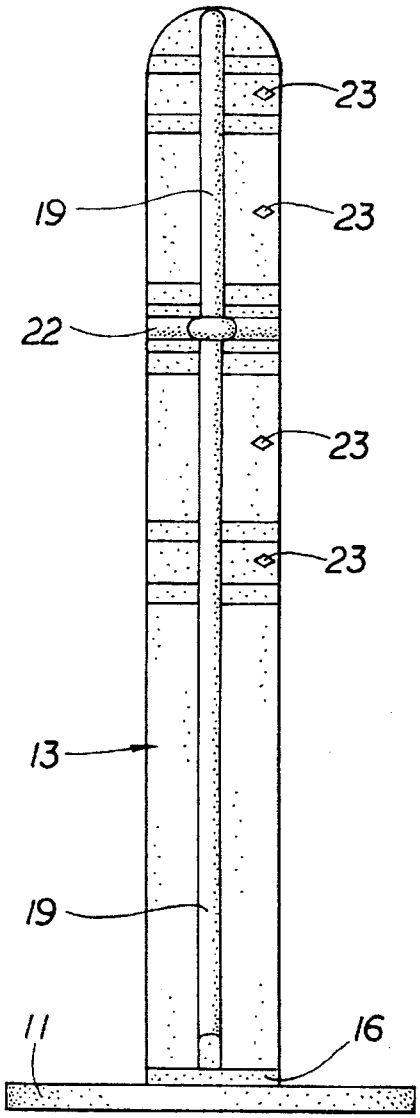
FIG. 4 is a rear elevational view of the device showing depth indicia.

FIG. 4 more clearly demonstrates the use of indicia on the exterior of the device to enable the device to function as a gauge. Indicia 23 indicating numerical depths of the device are located on the exterior of each member. In addition, an indicia bead 22 is molded onto the exterior of the device to indicate optimum burial depth of the device. Bead 22 may be molded integrally with the manufacture of the device, or added later with hot glue or plastic. The bead enables inspectors or foremen to physically inspect the depth by probing. Typically, the bead 22 and other indicia 23 will be colored differently than the member color to enhance discernibility.

Figure 5:
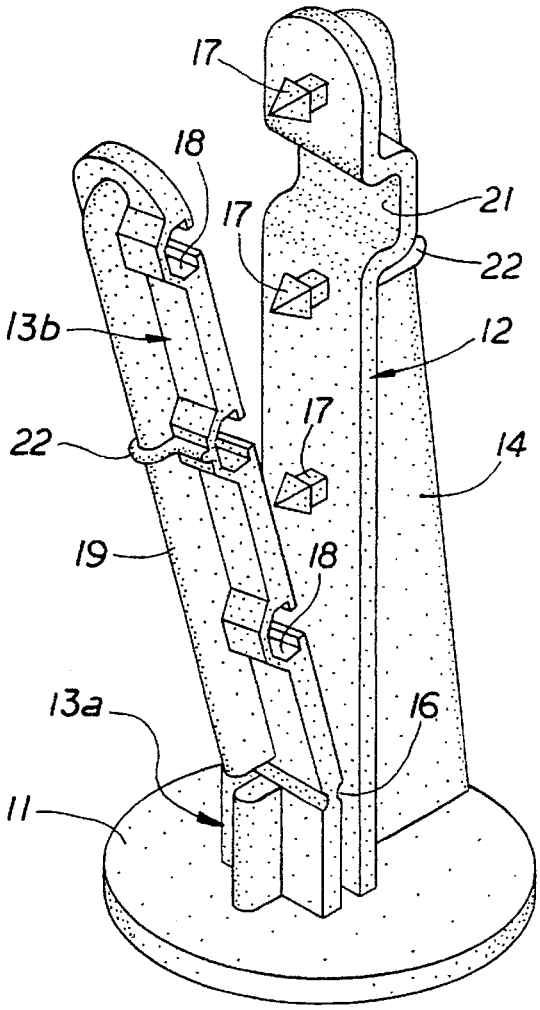
FIG. 5 is a perspective view showing the entire device with the hinge element raised from the disk base.

FIG. 5 shows the device with a two segmented member 13. Lower segment **13*a* is rigidly attached to base 11 at a lower end, and an upper end is attached to segment 13*b* by hinge 16. FIG. 5 shows a living hinge 16 integral with 13*b* and 13*a*, but a separate element hinge may be used. In this embodiment, segment 13*a* interlocks with fixed member 12 in the same way as the nonsegmented member of FIG. 1. A two-segmented member creates additional stability at the connection point of member 13*a* to base 11**.

FIG. 6 shows a construction site in which a silt barrier 37 has been erected and silt anchors 36 placed at a mid-point between each primary support 32. Each device 36 has been properly buried to a predetermined depth, and indicia 22 on the top of the device 36 indicates a proper burial depth. An inspector or foreman can now readily ascertain whether the silt barrier has been constructed to the proper construction code and be confident that the barrier will function properly to prevent erosion. Similar protection can be established in an aquatic environment (not shown). The base 11 of the device can be weighted so that underwater excavation of a trench is unnecessary. Primary supports for an aquatic silt curtain may simply be driven into the mud or silt floor of the aquatic area and a weighted silt anchor device can be attached to the silt curtain at periodic intervals and "sunk" in proper locations. Because the pivotal members of the silt anchor can clamp the silt barrier down to the base, a flat weighted base can provide an adequate barrier to silt or floating debris intruding into a protected aquatic area. To provide additional protection to sensitive areas, the anchoring invention should be made from non-corrosive, non-toxic, and non-leeching material. Various color schemes can be devised to differentiate various types of silt anchors (e.g. weighted versus non-weighted), and to increase visibility.

What is claimed is:

1. An anchoring apparatus for securing a lower margin of a silt curtain on the ground, comprising:

a) a substantially planar base;

b) a first elongated member having one end mounted to said base;

c) a second elongated member having one end pivotally mounted on said base, said second member opposing said first member said first and said second member each having a height substantially lower than a height of said silt curtain; and d) locking means for securing said lower margin of said silt curtain between said first member and said second member, said locking means locking said first and said second member to each other.

2. An anchoring apparatus as recited in claim 1, wherein said base is of sufficient size and mass for anchoring said apparatus within a trench and wherein said base is buried a predetermined depth below the surface of the ground upon filling said ditch with earth.

3. An anchoring apparatus as recited in claim 1, wherein said base is weighted.

4. An anchoring apparatus as recited in claim 1, wherein said first member is mounted on said base adjacent said second member.

5. An anchoring apparatus as recited in claim 4, wherein said base is substantially disk shaped and having a center, and wherein said first member is mounted at said center of said base.

6. An anchoring apparatus as recited in claim 1, further including a hinge interconnecting said second member and said base, such that said second member is pivotal relative to said base.

7. An anchoring apparatus as retired in claim 1, wherein said second member is mounted on said base through a living hinge of resilient plastic.

8. An anchoring apparatus as recited in claim 7, wherein said base, said first member, and said second member are integrally molded and connected in a plastic injection molding process.

9. An anchoring apparatus as recited in claim 1, wherein said first member is pivotally mounted on said base.

10. An anchoring apparatus as recited in claim 1, wherein said second elongated member comprises an upper elongated section and a lower elongated section, said lower section having an upper and lower end thereof, pivot means connecting said upper section to said lower section at said upper end, wherein said lower end is rigidly connected to said base and wherein said first member has a substantially planar side opposite said locking means, said planar side including a planar support buttress extending orthogonally therefrom, said buttress having a bottom coextensively integrated into said base so that said first member is rigidly fixed to said base.

11. An anchoring apparatus as recited in claim 10, wherein said pivot means comprises a living hinge of resilient plastic.

12. An anchoring apparatus as recited in claim 1, further including fence connection means for attaching said apparatus to a wire fence.

13. An anchoring apparatus as recited in claim 12, said fence connection means comprising a transverse recess formed in said first member adapted to receive fence wire therein so that said apparatus may be attached to a wire fence.

14. An anchoring apparatus as recited in claim 12, said fence connection means comprising a transverse recess formed in said second member adapted to receive fence wire therein so that said apparatus may be attached to a wire fence.

15. An anchoring apparatus as recited in claim 1, wherein said apparatus includes a gauge means for indicating a depth of said base below the surface of the ground.

16. An anchoring apparatus as recited in claim 15, wherein said gauge means comprises markings on an exterior surface of said apparatus so that a depth of said base below the surface of the ground is readily discernible.

17. An anchoring apparatus as recited in claim 1, wherein said locking means comprises:

a) a plurality of snap-fit plugs formed on a surface of one of said elongated members, each plug having a flange; and b) a plurality of recesses formed on a surface of said other adjacently positioned elongated member, each recess adapted for receiving a corresponding plug from said other adjacent member so that said plugs retain said silt curtain material therebetween and so that said flange retains said plug within said recess after insertion and such that said members are locked together.

18. An anchoring apparatus as recited in claim 1, wherein said locking means comprises:

a) a plurality of snap-fit plugs formed on a surface of said second member opposite said first member, each plug having a flange; and b) a plurality of recesses formed on a surface of said first member, each recess adapted for receiving a corresponding plug from said opposing second member such that said flange retains said plug within said recess after insertion, such that said second member is locked to said first member.

19. An anchoring apparatus as recited in claim 1, wherein said locking means comprises a plurality of snap-fit plugs and a plurality of recesses formed on a surface of said second member opposing said first member, a plurality of snap-fit plugs and a plurality of recesses formed on a surface of said first member opposing said second member, each plug having a flange, and wherein each plug on each member has a corresponding recess on said opposing member adapted for receiving said opposing plug so that said flange retains said plug within said corresponding recess after insertion, such that said second member is locked to said first member.

20. An anchoring apparatus as recited in claim 1, wherein said apparatus is comprised of non-corrosive, non-toxic, and non-leeching material.

21. An anchoring apparatus as recited in claim 1, wherein said apparatus is brightly colored.

22. An anchoring apparatus for securing a lower margin of a silt curtain on the ground, comprising:

a) a substantially planar base having a sufficient size and mass for securing said apparatus in a ditch, said base buried a predetermined depth below the surface of the ground upon filling said ditch with earth;

b) a first elongated member having one end rigidly mounted to said base, c) a second elongated member having one end pivotally mounted on said base adjacent said first member, said first and said second elongated member each having a height exceeding said lower margin and less than a total height of said silt curtain; and d) locking means for securing said silt curtain between said first member and said second member, said locking means locking said first and said second member to each other.

23. An anchoring apparatus as recited in claim 22, wherein said locking means comprises:

a plurality of snap-fit plugs formed on a surface of one of said elongated members, each plug having a flange and a piercing tip for puncturing silt curtain material; and b) a plurality of recesses formed on a surface of said other adjacently positioned elongated member, each recess adapted for receiving a corresponding plug from said other adjacent member so that said plugs pierce said silt curtain material and so that said flange retains said plug within said recess after insertion and such that said members are locked together.

24. An anchoring apparatus as recited in claim 22, wherein said locking means comprises a plurality of snap-fit plugs and a plurality of recesses formed on a surface of said second member adjacent said first member, a plurality of snap-fit plugs and a plurality of recesses formed on a surface of said first member adjacent said second member, each plug having a flange, and wherein each plug on each member has a corresponding recess on said adjacent member adapted for receiving said adjacent plug so that said flange retains said plug within said corresponding recess after insertion, such that said second member is locked to said first member.

25. An anchoring apparatus for securing a lower margin of a silt curtain below the ground, comprising:

a) a substantially planar base having a sufficient diameter for securing said apparatus in a ditch, said base buried a predetermined depth below the surface of the ground upon filling said ditch with earth;

b) a first elongated member;

c) a second elongated member positioned parallel to said first member, and wherein said first and said second members each have a height substantially less than a height of said silt curtain;

d) means for pivotally connecting an end of one of said members with an end of said other member and for fixedly joining said connected ends with said planar base;

e) locking means for securing said silt curtain between said first member and said second member, said locking means locking said first and said second member to each other; and f) gauge means for indicating a depth of said base below the surface of the ground.

26. An anchoring apparatus as recited in claim 25, wherein said locking means comprises:

a) a plurality of snap-fit plugs formed on a surface of one of said elongated members, each plug having a flange and a piercing tip for puncturing silt curtain material; and b) a plurality of recesses formed on a surface of said other adjacently positioned elongated member, each recess adapted for receiving a corresponding plug from said other adjacent member so that said plugs pierce said silt curtain material and so that said flange retains said plug within said recess after insertion and such that said members are locked together.

27. An anchoring apparatus as recited in claim 25, wherein said locking means comprises a plurality of snap-fit plugs and a plurality of recesses formed on a surface of said second member adjacent said first member, a plurality of snap-fit plugs and a plurality of recesses formed on a surface of said first member opposing said second member, each plug having a flange, and wherein each plug on each member has a corresponding recess on said opposing member adapted for receiving said opposing plug so that said flange retains said plug within said corresponding recess after insertion, such that said second member is locked to said first member.

28. An anchoring apparatus as recited in claim 25, wherein said gauge means comprises indicia on an exterior surface of said apparatus indicating a depth of said base below the surface of the ground.

29. An anchoring apparatus for securing a lower margin a silt curtain on the ground, comprising:

a) a substantially planar base having a sufficient size and mass for securing said apparatus in a ditch, said base buried a predetermined depth below the surface of the ground upon filling said ditch with earth;

b) a first elongated member having one end rigidly mounted to said base, c) a second elongated member having one end pivotally mounted on said base adjacent said first member;

d) fence connection means for attaching said apparatus to a wire fence; and, e) locking means for securing said silt curtain between said first member and said second member, said locking means locking said first and said second member to each other.

30. An anchoring apparatus as recited in claim 29, said fence connection means comprising a transverse recess formed in said first member adapted to receive fence wire therein so that said apparatus may be attached to a wire fence.

31. An anchoring apparatus as recited in claim 29, said fence connection means comprising said second member further including a substantially flat face opposing said first member, said face having a transverse recess formed in said first member adapted to receive fence wire therein so that said apparatus may be attached to a wire fence.

32. An anchoring apparatus as recited in claim 29, wherein said locking means comprises:

a) a plurality of snap-fit plugs formed on a surface of said first member opposing said second member, each plug having a flange; and b) a plurality of recesses formed in a surface of said second member, each recess adapted for receiving a corresponding plug from said first member so that said flange retains said plug within said recess after insertion, such that said first member is locked to said second member.

33. An anchoring apparatus as recited in claim 29, wherein each of said members includes a flat surface facing one another and said locking means comprises:

a) a plurality of snap-fit plugs formed on said flat surface of one of said elongated members, each plug having a flange and a piercing tip for puncturing silt curtain material; and b) a plurality of recesses formed on said flat surface of said other adjacently positioned elongated member, each recess adapted for receiving a corresponding plug from said other adjacent member so that said plugs pierce said silt curtain material and so that said flange retains said plug within said recess after insertion and such that said members are locked together.

34. An anchoring apparatus as recited in claim 29, wherein said locking means comprises a plurality of snap-fit plugs and a plurality of recesses formed on a surface of said second member opposing said first member, a plurality of snap-fit plugs and a plurality of recesses formed on a surface of said first member opposing said second member, each plug having a flange, and wherein each plug on each member has a corresponding recess on said opposing member adapted for receiving said opposing plug so that said flange retains said plug within said corresponding recess after insertion, such that said second member is locked to said first member.

35. An anchoring apparatus for securing a lower margin of a silt curtain on the ground, comprising:

a) a substantially planar base having a sufficient diameter for securing said apparatus in a ditch, said base buried a predetermined depth below the surface of the ground upon filling said ditch with earth;

b) a first elongated member having one end rigidly mounted to said base;

c) a second elongated member having one end pivotally mounted on said base adjacent said first member, said first and said second members each having a height substantially lower than a height of said silt curtain;

d) fence connection means for attaching said apparatus to a wire fence;

e) locking means for securing said lower margin of said silt curtain between said first member and said second member, said locking means locking said first and said second member to each other; and f) gauge means formed on at least one elongated member for indicating a depth of said base below the surface of the ground.

36. An anchoring apparatus as recited in claim 35, said fence connection means comprising a transverse recess formed in said first member adapted to receive fence wire therein so that said apparatus may be attached to a wire fence.

37. An anchoring apparatus as recited in claim 25, said fence connection means comprising said first member further including a substantially flat face opposing said second member, said face having a transverse recess adapted to receive fence wire therein so that said apparatus may be attached to a wire fence.

38. An anchoring apparatus as recited in claim 35, wherein each of said members includes a flat surface facing one another and said locking means comprises:

a) a plurality of snap-fit plugs formed on said flat surface of one of said elongated members, each plug having a flange and a piercing tip for puncturing silt curtain material; and b) a plurality of recesses formed on said flat surface of said other adjacently positioned elongated member, each recess adapted for receiving a corresponding plug from said other adjacent member so that said plugs pierce said silt curtain material and so that said flange retains said plug within said recess after insertion and such that said members are locked together.

39. An anchoring apparatus as recited in claim 35, wherein said locking means comprises a plurality of snap-fit plugs and a plurality of recesses formed on a surface of said second member opposing said first member, a plurality of snap-fit plugs and a plurality of recesses formed on a surface of said first member opposing said second member, each plug having a flange, and wherein each plug on each member has a corresponding recess on said opposing member adapted for receiving said opposing plug so that said flange retains said plug within said corresponding recess after insertion, such that said second member is locked to said first member.

40. An anchoring apparatus as recited in claim 35, wherein said gauge means comprises markings on an exterior surface of said apparatus so that a depth of said base below the surface of the ground is readily discernible.

41. An anchoring apparatus as recited in claim 25, wherein said first elongated member has a substantially planar outer side positioned opposite said locking means, said outer side including a planar support buttress extending orthogonally therefrom, and wherein said buttress has a bottom coextensively integrated into said base such that said buttress supports and fixes said first member to said base.

42. An anchoring apparatus as recited in claim 29, wherein said first elongated member has a substantially planar outer side positioned opposite said locking means, said outer side including a planar support buttress extending orthogonally therefrom, and wherein said buttress has a bottom coextensively integrated into said base such that said buttress supports and fixes said first member to said base.

43. An anchoring apparatus as recited in claim 35, wherein said first elongated member has a substantially planar outer side positioned opposite said locking means, said outer side including a planar support buttress extending orthogonally therefrom, and wherein said buttress has a bottom coextensively integrated into said base such that said buttress supports and fixes said first member to said base.

* * * * *